United States Patent [19]

Redman et al.

[11] Patent Number: 4,586,425

[45] Date of Patent: May 6, 1986

[54] CLAMP LOCKING DEVICE

[75] Inventors: Paul G. Redman; John M. Speicher, both of Upland, Calif.

[73] Assignee: General Dynamics Pomona Division, Pomona, Calif.

[21] Appl. No.: 157,757

[22] Filed: Jun. 9, 1980

[51] Int. Cl.[4] ..... F15B 13/02

[52] U.S. Cl. ..... 91/45; 92/24; 92/27; 188/67; 188/77 R; 292/252; 292/256.65

[58] Field of Search ..... 92/24, 23, 27, 28; 188/77 R, 67; 292/252, 256.65; 91/45

[56] References Cited

U.S. PATENT DOCUMENTS

| | | | |
|---|---|---|---|
| 2,636,578 | 4/1953 | Swift | 188/77 R |
| 2,667,240 | 1/1954 | Wilkinson | 188/77 R |
| 2,713,328 | 7/1955 | Driskel . | |
| 3,107,582 | 10/1963 | Royster | 92/24 |
| 3,108,513 | 10/1963 | Koshobu | 92/27 |
| 3,208,759 | 9/1965 | Firestone | 279/4 |
| 3,324,771 | 6/1967 | Cruse | 92/24 |
| 3,342,111 | 9/1967 | Royster | 92/24 |
| 3,397,620 | 8/1968 | Skelton | 92/24 |
| 3,429,605 | 2/1969 | Soesbergen | 292/256.65 |
| 3,464,528 | 9/1969 | Mork | 188/77 R |
| 3,584,544 | 6/1971 | Haberman | 92/24 |
| 3,819,016 | 6/1974 | Radcliffe | 188/77 R |
| 4,093,184 | 6/1978 | Wieschel | 188/77 R |

FOREIGN PATENT DOCUMENTS

| | | | |
|---|---|---|---|
| 2128156 | 12/1972 | Fed. Rep. of Germany | 92/28 |

*Primary Examiner*—Abraham Hershkovitz

*Attorney, Agent, or Firm*—Henry M. Bissell; Edward B. Johnson

[57] ABSTRACT

A piston-controlled locking mechanism including an external cylinder having annular retaining means, a first elongated piston located adjacent the cylinder and having ball lock positioning apertures in the extension, a second coaxially located piston positioned inside of the skirt of the first piston and having indentations capable of mating with the ball positioning portions of the first piston, and positioning elements for first moving the inner piston to release the balls and thereafter moving the outer piston to either release or lock the cylinder.

13 Claims, 7 Drawing Figures

CLAMP LOCKING DEVICE

BACKGROUND OF THE INVENTION

1. Field of the Invention

The present invention generally relates to locking mechanisms and, in particular, to a specialized lock for securing a clamping device.

2. Description of the Prior Art

The prior art is rife with examples of locking devices. Many attempts have been made to overcome wear problems where positive locking is required, for example, in airplane landing gear. Further, very complex locking devices are disclosed in the art. U.S. Pat. No. 2,713,328 of Driskel et al positions and locks an internal shaft by the provision of a raised portion on the shaft and a series of balls positionable in indentations in the raised portion. The lock is actuated selectively, and depends upon the operation of a clamp device external to the rod. This type of unit is subject to wear, and adjustment is not possible due to the contact between the indentations, the balls, and the clamp. Thus, there is a need in the art for units in which wear of the component parts can be at least partially compensated for, for example, by adjusting the position of the locking portion at the time of locking.

One method of taking care of this particular wear problem is disclosed by Firestone in U.S. Pat. No. 3,208,759. In this patent, a collet seal utilizes a base and lip on the inner cylinder as the contact points for the balls, and maintains them in close contact with a slideable member which contacts the lip on the cylinder. This type of unit, however, does not provide positive locking, although it does overcome the problem of gradual deterioration and wear, and thus looseness in the ball area.

Another method of overcoming the loss of tight sealing is disclosed in U.S. Pat. No. 3,397,620 of Skelton et al. In this reference, spring loading is provided to position the locking balls, and the shaft to be locked is further spring loaded. However, this type of system has the drawback of wear by repeated use of the springs, and the possibility that external forces would overcome the effect of the springs, independent of the fluid loading system.

Cruse in U.S. Pat. No. 3,324,771 discloses a friction operating mechanism with locking means. In this system, separate springs of differing characteristics are utilized and positioned in such a manner that one of them is compressed at all times. Locking is effected by pivoted members that contact a lip on the center of an inner piston. This type of system overcomes some of the above problems in that it provides for a positive lock and compensates for wear. However, the use of opposed springs presents a different problem, i.e., that of possible spring breakage or loss of pressure due to use.

One system of overcoming the opposed spring type of problem is disclosed in U.S. Pat. No. 3,584,544 to Haberman, in which a single spring is used to load a central piston, and positive locking is effected by shaped rollers and keys. However, this system still requires the use of at least one spring to place tension upon the locking portion of the system and must be utilized in conjunction with a large contact surface roller which would be subject to wear and eventual positive locking problems. R. H. Royster in U.S. Pat. No. 3,107,582 discloses another system similar to that of Haberman. However, instead of using rollers, Royster utilizes radially oriented rods having specific cut out portions on the upper and lower surfaces thereof. This type of unit thus suffers from the same spring wear problems as the other prior art, and the above wear problems when dealing with locking by a rod.

It is another object of the present invention to provide a simple locking mechanism that does not depend upon flui pressure to retain a predetermined position.

It is further object of the present invention to provide such a locking device in a very simple, easy to construct form.

SUMMARY OF THE INVENTION

The cylindrical locking device of the present invention may be either hydraulically or mechanically operated, depending upon the particular use of the lock. In a preferred form, the unit is fluid operated, and is coupled to a ring clamp having a circular shape, with a single gap. On one side of the gap there is an attachment positioning the piston rod of the lock of the present invention, and the locking mechanism is mounted on the other side of the gap. The ring is normally provided with lips on either edge thereof to effect clamping.

In the lock itself, a single external cylinder is provided with an aperture for the piston rod, and a first external piston is provided with a long extension or skirt having mounted therein a plurality of circular locking elements, preferably metal balls. The cylinder is provided with at least one annular aperture which retains the balls when the piston is in a locked condition. In addition, a second set of apertures may be provided in order to lock the cylinder in the second or open position.

Within the skirt of the external larger piston, a second piston is provided. This piston operates with the exterior piston to positively position the balls in the locking indentation provided in the cylinder. The internal piston is actuated during locking or unlocking operations, prior to the external piston, and releases the balls into indentations provided in the internal piston, and thus allows the external piston to move and either lock or unlock the cylinder.

It should be further noted that the arrangements of the two pistons, and the cooperation between them and the cylinder maintains a positive lock without requiring the provision of fluid pressure. The locking cylinder of the present invention is designed so that the ordinary stress provided by the locking function itself will, in fact, positively seal the balls in the indentation in the cylinder, and prevent motion. This particular design is particularly useful, when, for instance, the locking cylinder of the present invention is used as a lock to position a gyro in small rockets. This positive locking function, which is effective even when tremendous force is applied against the locking mechanism, is one of the most desirable results obtained by the cylinder lock of the present invention.

It should be noted that the cylinders may be either single or double acting, i.e., that they may have a locked position only, and be otherwise slideable or movable if not locked, depending upon structural limitations as defined by the outer cylinder. However, in the preferred form, the locking cylinders of the present invention are "double acting" in that they lock in a plurality of positions. In this preferred form, the cylinder would lock in a relatively closed position to hold the associated clamp closed tightly about the item to be sealed. In the alternative, the cylinder would be locked in the relatively open position to urge the metallic ring of the clamp open and allow easy access to and separation of the items being held together. The advantage of this particular function is that the clamp ring may be of a heavier, stronger construction, and thus less flexible. When a less flexible ring is utilized, or a ring that would be stressed past the point of returning to its original shape, the ease of access for installation and removal of the equipment held in place by the ring could be jeopardized. The use of the double acting locking cylinder of the present invention, however, allows almost twice the expansion from the closed to the open position without stressing the ring past its yield point. That is, the ring and the piston throw on the double acting locking cylinder could be manufactured in such a manner that when the cylinder is locked open, the ring is stressed almost to its yield point, and when the cylinder is locked closed, the ring is also stressed almost to its yield point. Thus, the double acting cylinder of the present invention constitutes a specific preferred embodiment of the present invention.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENTS

Figure 1:
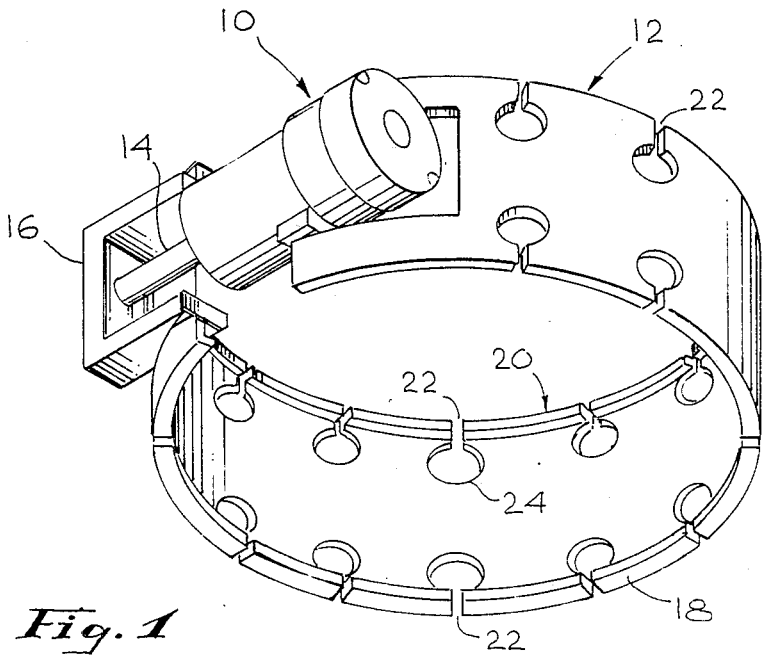
FIG. 1 is a perspective view of a locking ring utilizing a locking cylinder of the present invention.

In FIG. 1, a clamp type lock embodiment of the present invention is depicted. In this unit the locking cylinder 10 is, preferably, pivotally attached to ring 12 on one side, and piston rod 14 is pivotally attached to ring 12 at guard 16. In operation, when the locking cylinder is actuated, rod 14 is drawn into cylinder 10, and the circle decreases in diameter. Ring 12 is provided with lips 18 and 20 in order to attach, for instance, two different components together by use of the clamp. Further, since the present clamp ring is preferably used in situations where very positive clamping is necessary, the ring is normally made of a relatively heavy metallic substance, and in order to decrease the fore necessary to clamp the ring, slots 22 are provided through lips 18 and 20 and an aperture in 24 is provided adjacent each slot. In this form after the clamping has occurred, a relatively solid clamping surface is provided. The result is that the force necessary to produe this surface is decreased.

Figure 2:
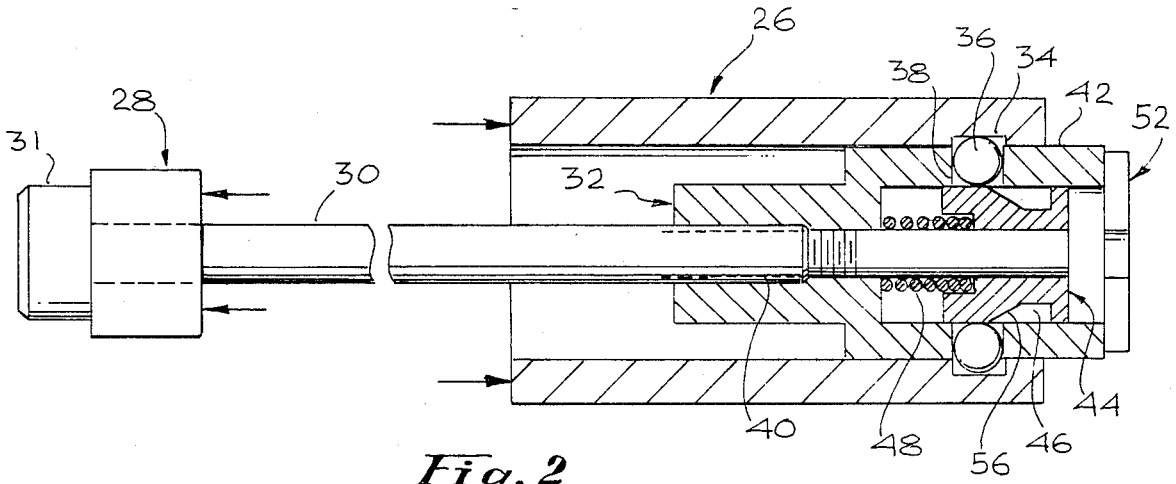
FIG. 2 is a longitudinal section of a mechanically actuated locking cylinder.

In FIG. 2, a cross section of one of the embodiments of the present invention is depicted. The unit shown is in a locked position, with force from the ring being applied both to cylinder 26 and rod mounts 28 as shown by the arrows. In this embodiment piston rod 30 has a cap 31 which positions rod 30 against mounts 28. In this embodiment, cylinder 26 is slideably engaged with primary piston 32. Such engagement may be through bushings, bearings or other friction reducing means (not shown) as desired. Cylinder 26 is provided with an annular indentation 34 to receive locking balls 36 which are mounted in radial holes 38 in primary piston 32. It should be noted that, if necessary, in order to prevent balls 36 from falling out of place, holes 38 may be swaged so that one of the hole radii is slightly less than the diameter of the ball. Piston 32 is shown connected to rod 30 by screw fitting 40, but may be attached by other means if desired, the limitation being that, for servicing purposes, the unit should be manufactured in such a manner as to allow removal of the cylinder from the ring or other unit that is to be locked.

Figure 3:
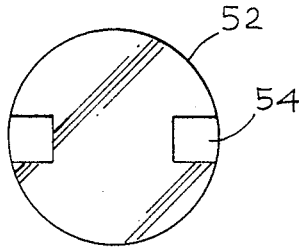
FIG. 3 is an end view of the access means for releasing the locking mechanism shown in FIG. 2.

Coaxial with primary piston 32, and mounted inside of skirt 42, is secondary piston 44 which is provided with indentations 46 in a position such that they will mate with holes 38 during operation. The normal position for secondary piston 44, due to the pressure produced by spring 48, is the closed position, i.e., a position where balls 36 are forced into annular groove 34. This is the locked position as shown in FIG. 2. When the cylinder is to be unlocked, plate 52 is used by inserting a tool in the indentations 54 (as better shown in FIG. 3) and depressing secondary piston 44 against the pressure of spring 48, thus urging secondary piston 44 to the left, releasing balls 36 into indentations 46, and allowing the lock to release. During operation, the force against the piston, as noted, will force balls 36 into indentations 46 along beveled surface 56, and allow both the primary and secondary pistons to move to the left.

Figure 4:
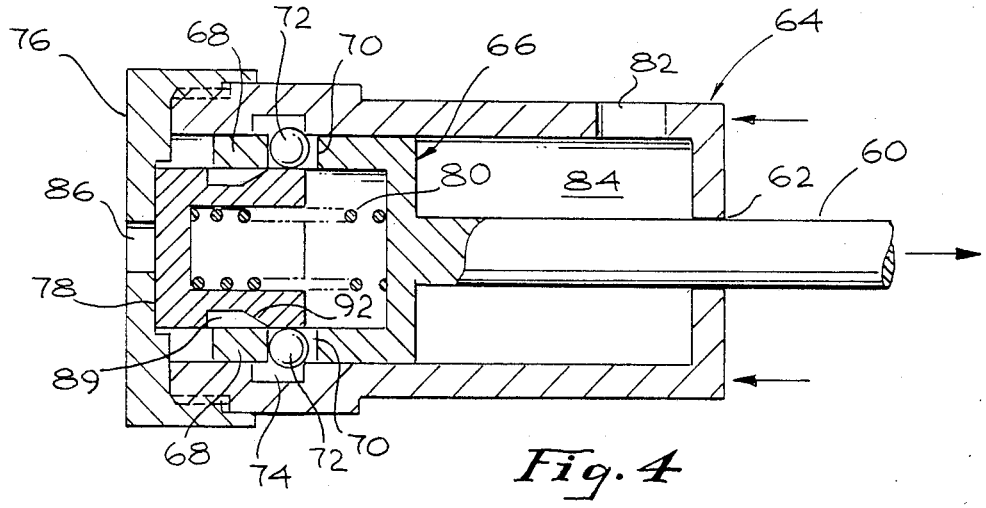
FIG. 4 is a cross-sectional view of the cylinder of another embodiment.

The embodiment shown in FIG. 4 is a hydraulic or pneumatic modification of the locking cylinder of the present invention. In this figure, piston rod 60 is slideably positioned in aperture 62 of cylinder 64 and is capable of moving within cylinder 64. Rod 60 is integral with or connected to piston 66 which has an elongated skirt 68 and a plurality of apertures 70 which receive locking balls 72. Cylinder 64 is further provided with annular indentation 74 which forms the cylinder locking portion of this embodiment, and is sealed, at the left end, by cap 76 which is preferably threaded to the outer surface of cylinder 64 for removal and repair, should they be needed.

As in the other embodiments of the present invention, secondary piston 78 is positioned inside primary piston skirt 68. Secondary piston 78 is urged to the left by the compression of spring 80 when the system is in the locked position (as shown), and thus primary piston 66 is urged to the right in this condition. As a result, positive locking contact between balls 72, annular aperture 74, primary piston 66, and secondary piston 78 is produced. Further, the positive locking characteristics of the locking cylinder of the present invention are enhanced when used in a clamp lock system by virtue of the fact that the clamp is forced to a closed or compressed condition in locking, and, as a result, forces tending to move main cylinder 64 to the left and piston rod 60 to the right, are produed, as shown by the arrows in FIG. 4.

In order to lock and unlock the system in this embodiment, hydraulic or pneumatic port 82 is provided in cylinder 64. The port is used to pressurize chamber 84, and as a result, force main piston 66 to the left. The unlocking motion is produced through port 86 provided in cap 76. This port is pressurized to produce motion to the right and unlock the unit.

In the operation of this embodiment, in order to unlock the cylinder (it being shown in the locked position) fluid pressure is provided at port 86, which urges secondary piston 78 to the right, contrary to the force of spring 80, and as a result of the compression of spring 80, annular indentation 89 in secondary piston 78 is brought into communication with balls 78. At this point, the relative rightward force would allow balls 72 to move axially inwardly, and contact with annular aperture 74 will be terminated. Both pistons, the spring and the balls would then move the right, as shown, and be held together as a single entity by virtue of the spacing between cylinder 64, main piston 66, and secondary piston 78. In this unlocked condition, spring 80 would be in compression at all times. It should be further noted that once unlocking has occurred, it is not necessary to apply pressure to the system through port 86, as the positive unlocked function is effective.

In order to lock the cylinder, pressure is then applied to port 82, but it should be noted that the system can mechanically lock by merely forcing rod 60 into the cylinder and the following function will occur. After sufficient pressure has built up in chamber 84, piston 66 tends to move to the left, and when it has moved sufficiently to allow balls 72 into annular aperture 74, the balls will be forced radially outwardly along beveled edge 92 of secondary piston 78 due to the force exerted by spring 80. The system would then automatically lock and spring 80 would be released from compression, and seal piston 78 against cap 76 as previously discussed.

Figure 5:
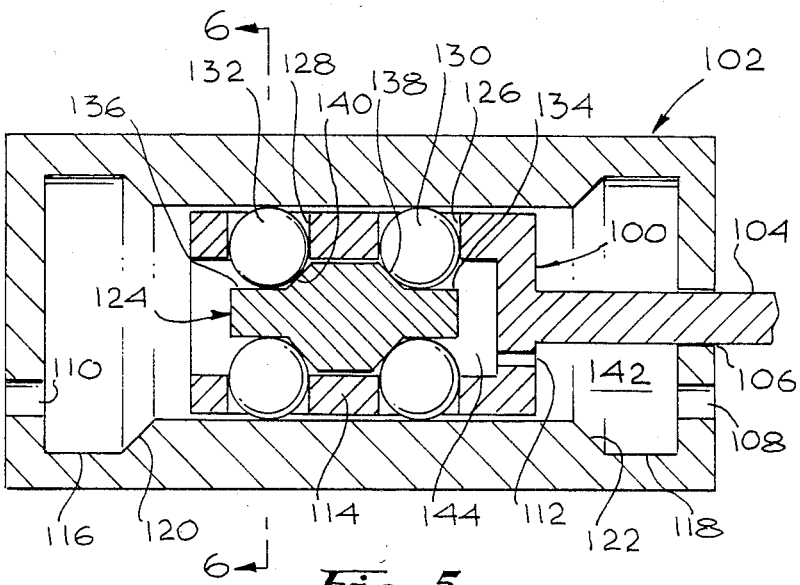
FIG. 5 is a cross-sectional view of an embodiment of a double acting version of the present invention.

A double acting version of the present invention is shown in FIG. 5 (the phrase "double acting" meaning that the system locks in two separate positions, and thus allows for the above-discussed increase in motion of the clamp lock in accordance with the present invention). In this embodiment, main piston 100 is positioned in cylinder 102 and has rod 104 extending through aperture 106 in cylinder 102. Cylinder 102 is provided with fluid ports at 108 and 110. Piston 100 is provided with a fluid port at 112, and an elongated skirt 114, as in the other embodiments. Cylinder 102 is provided with annular indentations 116 and 118 at either end, and the indentions are provided with beveled edges 120 and 122.

As in the other embodiments of the present invention, coaxial internal secondary piston 124 is slideably positioned inside piston skirt 114. In this embodiment piston 100 has two sets of apertures 126 and 128, with apertures 126 being fitted with balls 130 which are used to hold the cylinder in the locked open position, and balls 132 being fitted in apertures 128 to position the cylinder in the locked closed mode. Internal piston 124 is provided with annular indentations 134 and 136 which are beveled at 138 and 140 to insure appropriate motion of balls 130 and 132.

The unit is shown in FIG. 5 in the transition status, and is being operated to the locked open position by pressurization through port 110, which forces both pistons to the right. As a result, when primary piston 100 has moved sufficiently to the right to allow balls 130 to contact beveled surfaces 122, the pressure on secondary piston 124 will be transmitted to beveled edges 138 and force balls 130 radially outwardly into the locked position, with piston 124 being moved to the right and into contact with primary piston 100. It should be noted that the allowable motion to the right for secondary piston 124 is controlled by the length of the piston, and that the axial distance between the pistons is designed such that when piston 124 has moved fully to the right, beveled surface 138 will be at least slightly past the center of balls 130 to insure positive locking.

In order to move the cylinder of this embodiment from the locked open position to the locked closed position, pressurized fluid is supplied through port 108 into chamber 142 and, via port 112 to chamber 144. This pressurization overcomes the above-described locked open condition for piston 124, and moves it to the left, releasing balls 130 so that the pressure on piston 100 from the fluid in chamber 142 forces balls 130 along beveled surface 122, and as a result, the balls and the primary and secondary pistons move to the left.

After the piston 114 has traveled to the left a sufficient distance for the second set of balls 132 to reach beveled surface 120, they are directed radially outward by pressure applied to piston 124 in chamber 144 in the same manner as described above. The result, then, is a positively locked closed condition.

Figure 6:
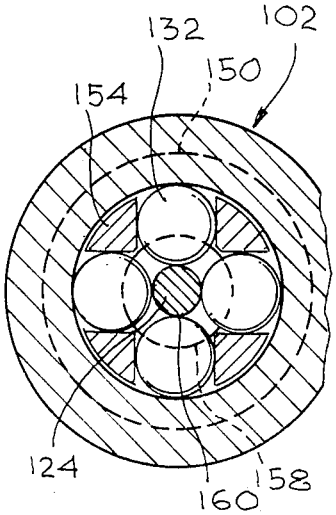
FIG. 6 is a section taken along line 6—6 of FIG. 5.

In FIG. 6, a section taken along line 6—6 of FIG. 5, cylinder 102 is shown in section, with broken line 150 showing the depth of the annular indentation in the cylinder. Balls 132 are held in place by members 154 which are portions of the skirt of piston 100. The secondary piston 124 is shown in close contact with balls 132, shown in the released position. The outer diameter of secondary piston 124 is shown at 158, with the beveled smaller diameter being shown at 160.

Figure 7:
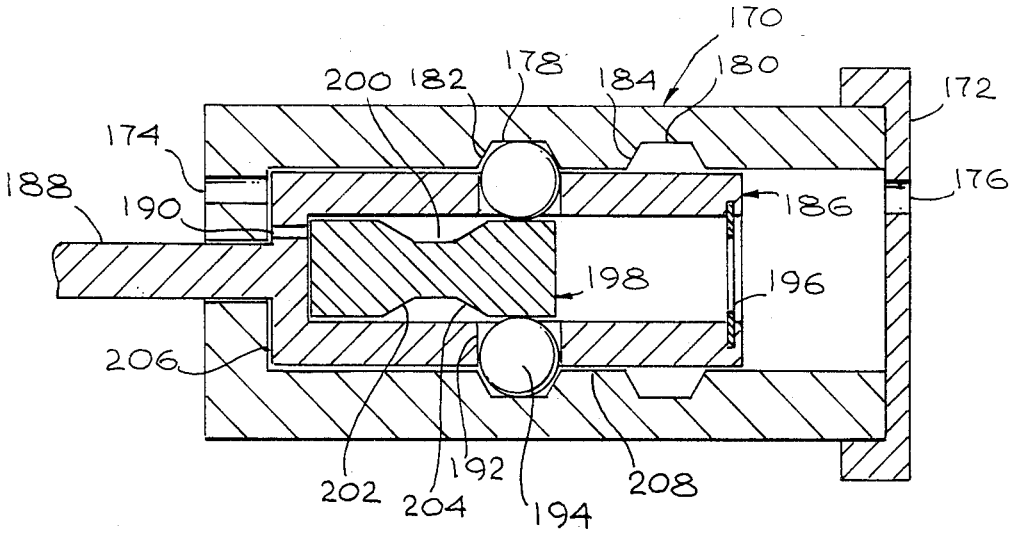
FIG. 7 is another double acting embodiment in accordance with the present invention.

Referring to FIG. 7, cylinder 170 of this embodiment is provided with end cap 172 and fluid port 176. Another fluid port 174 is provided at the opposite end of cylinder 170. Further, cylinder 170 has two annular indentations 178 and 180, beveled at 182 and 184, respective. Primary piston 186 with associated piston rod 188 is provided with fluid port 190 and a single set of apertures 192 to position locking balls 194. The skirt of piston 186 is provided with locking ring 196 to limit the travel of secondary piston 198. Secondary piston 198 is provided with annular indentation 200 which is beveled at both sides 202 and 204.

The cylinder of this embodiment is shown in the locked open position, and is moved to the locked closed position by pressurization through port 174 which communicates through port 190 to pressurize piston 198 and move secondary piston 198 to the right. In so doing, annular space 200 is opened to contact with balls 194 and due to bevels 182 and 204, and the pressure applied to primary piston 186 at surface 206, balls 194 move radially inward, releasing the unit so that both pistons and the balls travel to the right. During this motion, the whole of the internal portion of the unit is held in place by the internal structure thereof, and in particular by surface 208 on cylinder 170. The unit is continuously under pressure during the travel to the right, and thus when balls 194 reach annular aperture 180, the force on secondary piston 198 pushes the balls radially outward along bevel 202 of secondary piston 198, and bevel 184 of cylinder 170. Piston 198 continues to travel to the right until it is stopped by ring 196, and at that time, it has traveled past the beveled portion 202 of its surface, and has locked balls 194 with the lock in the closed position.

In order to release the unit from the locked closed position, pressure is applied through port 176, and the pressure forces piston 198 to the left, releasing balls 194 in the manner discussed above, and then forces the whole unit to the left until it is relocked, as shown in the drawing.

It should be noted, in particular, that the drawings of the present disclosure do not show the normal sealing rings for fluid pressure units, and such rings may be provided, if desired, depending upon pressure characteristics, the size of the cylinder, and other factors. However, they are not always necessary in the present units. Additionally, the drawings have shown a plurality of ball locks, and it is to be understood that even a single ball lock, if desired, would perform the same function. However, in order to retain symmetry, a minimum of two balls should be utilized, and a larger number of balls will be determined by such factors as the diameter of the cylinder, and the size of the balls desired. In one particular version, a unit that is only ¾ of an inch long, four balls 0.030 inches in diameter have been utilized. In addition, in certain versions of the present invention, under certain circumstances, it is possible for the balls to be left free to travel in a radially inward or outward direction, not being retained by the cooperative action of the cylinder and the pistons. When a unit is designed in which this possibility occurs, it is preferred that apertures for the balls in the piston skirt be swaged in such a manner that they are removable only from the side where such travel is not possible and thus they are not free to fall out of place during use.

Finally, in the fluid operated versions of the units they may be preloaded at all times by the fluid which may be, for example, hydraulic or pneumatic (depending upon the particular use) in order to further assure that events such as vibration during storage or use does not release the lock. Additionally, the contact surface between the inner and outer piston of the double-acting lock of the present invention could be provided with, for instance, friction producing means such as an O-ring. This would decrease the probability that the mechanism could unlock if pressure were lost.

Although there have been described above specific arrangements of a locking cylinder, particularly for use with clamp locks in accordance with the invention, for the purpose of illustrating the manner in which the unit may be used to its advantage, it will be appreciated that the invention is not limited thereto. For example, although the invention has been disclosed in context of a clamp lock, the principles of the invention are equally applicable to a slide or linear type of locks or the like. Accordingly, any and all modifications, variations or equivalent arrangements which may occur to those skilled in the art should be considered to be within the scope of the invention as defined in the appended claims.

What is claimed is:

1. A clamping lock comprising:

a ring-shaped member having plural apertures on each lateral edge thereof and having a gap therein;

first lock positioning means on one side of said gap;

second lock positioning means on the other side of said gap;

a lock interconnecting said first and said second means comprising an external cylinder interconnected with the first lock positioning means and an external rod extending within the cylinder and connected to said second lock positioning means, said cylinder having internal annular lock receiving means;

an elongate piston positioned inside said cylinder and interconnected with the rod, the piston being hollow and having lock retaining orifices in an elongate portion thereof;

locking elements selectively engagable with said annular lock receiving means and positioned respectively in the orifices in the elongate portion of said piston; and a free floating piston movable axially within the hollow elongate portion and having at least one section of larger diameter effective to lock the clamp by positioning the locking elements in the annular lock receiving means in said cylinder, and at least one section of reduced diameter effective to release the clamp by releasing the locking elements from the annular lock receiving means.

2. The lock of claim 1 wherein said ring-shaped member further includes a lip on at least one lateral edge thereof.

3. The lock of claim 2 wherein said apertures project through the lip and are circular inside of said lip.

4. A double acting cylinder lock capable of being locked in two separate positions comprising:

an outer cylinder forming one attaching structure for said lock and having plural annular spaced-apart grooves internally therein;

a rod positioned in said cylinder and extending therefrom, the extension thereof forming a second attaching means for the lock;

a first piston with an elongate skirt attached to said rod and coaxially positioning said rod in said cylinder;

plural radial lock orifices in the elongate skirt of the first piston;

locking members positioned in said plural radial orifices capable of being positioned in the plural annular grooves; and a single second piston positioned coaxially in free floating juxtaposition within the elongate skirt of the first piston and having at least one circumferential indentation therein capable of communicating with the locking members;

the second piston being movable axially between a first position directing the locking members into one of the annular grooves in the outer cylinder, a second position permitting the locking members to withdraw from the annular grooves of the outer cylinder into the indentation in the second piston, and a third position directing the locking members into another of the annular grooves in the outer cylinder, whereby when said locking members are engaged with the indentation in the second piston the cylinder lock is unlocked, and whereby when the second piston engages the locking members on its outer surface, the first piston is locked in a position corresponding to one or the other of the spaced apart annular grooves in the outer cylinder.

5. The lock of claim 4 wherein the skirt of the first piston has longitudinally-spaced-apart first and second sets of radial lock orifices, each having a corresponding set of locking members therein, a first set of said locking members near one end of the first piston being adapted to engage a first one of the annular spaced-apart grooves in the outer cylinder, and a second set of said locking members near the other end of the first piston being adapted to engage a second one of the annular spaced-apart grooves in the outer cylinder.

6. The apparatus of claim 5 further comprising a spaced apart pair of annular indentations in the second piston, one annular indentation mating with the first set of radial lock orifices in the skirt of the first piston, and the other annular indentation mating with the second set of radial lock orifices in the skirt of the first piston.

7. The lock of claim 4 wherein an orifice is further provided at one end of the cylinder to supply fluid pressure effective to release the lock from a first position, and to lock it in a second position by acting on the pistons.

8. The apparatus of claim 7 wherein a fluid supply means is provided at the other end of the cylinder to unlock the cylinder at the second position, and to lock it at the first position by acting on the pistons.

9. A clamp locking device comprising:

a cylinder having a hollow bore closed at both ends by opposed cylinder end caps and at least one annular recess extending radially outward from the bore;

a primary piston slideably mounted within said bore and having a rod extending from one side of the piston through an aperture in one of said end caps, the primary piston further having an extended skirt defining an interior bore open at an end remote from the rod to communicate with the cylinder bore and further defining at least one set of apertures extending radially through the skirt;

a plurality of balls within the set of apertures movable radially between extended positions within the annular recess of the cylinder to lock the primary piston to the cylinder and retracted positions projecting into the interior bore of the primary piston to unlock the piston from the cylinder;

a single secondary piston movable axially in free floating juxtaposition within the bore of the primary piston and having at least one portion of larger diameter for slideably engaging the surface of the primary piston bore and driving the balls to their extended positions and at least one portion of reduced diameter to receive the balls in their retracted positions; and a plurality of ports for selectively admitting pressurized fluid to opposite ends of the cylinder bore and through the primary piston to the interior bore of the primary piston in order to control the locking and unlocking of the primary piston to the cylinder.

10. The device of claim 9 wherein the cylinder comprises two annular recesses at opposite ends of the cylinder bore, wherein the primary piston has two sets of apertures, the sets being spaced axially from each other and containing corresponding sets of balls, and wherein the secondary piston has two portions of reduced diameter at opposite ends thereof spaced to mate with respective sets of balls and separated by said one portion of larger diameter.

11. The device of claim 10 wherein, during operation of the device, travel of the secondary piston relative to the primary piston is limited to a distance which insures continued engagement with the sets of balls.

12. The device of claim 9 wherein the cylinder has two annular recesses spaced axially from each other and from opposite ends of the cylinder bore, wherein the primary piston includes a single set of apertures with a corresponding plurality of balls therein, such that through axial movement of the primary piston the plurality of balls are engageable in one or another of the annular recesses of the cylinder, and wherein the secondary piston includes a single portion of reduced diameter between opposed end portions of larger diameter.

13. The device of claim 12 further including means secured within one end of the primary piston skirt for retaining the secondary piston therein.

* * * * *